US005330366A

United States Patent [19]

Tsuji et al.

[11] Patent Number: 5,330,366

[45] Date of Patent: Jul. 19, 1994

[54] CONNECTOR WITH UNLOCKING MEMBER

[75] Inventors: Masanori Tsuji; Motohisa Kashiyama, both of Shizuoka, Japan

[73] Assignee: Yazaki Corporation, Japan

[21] Appl. No.: 101,710

[22] Filed: Aug. 4, 1993

[30] Foreign Application Priority Data

Aug. 4, 1992 [JP] Japan ..... 4-054683[U]

[51] Int. Cl.[5] ..... H01R 13/627

[52] U.S. Cl. ..... 439/352

[58] Field of Search ..... 438/345, 347, 350, 352, 438/353, 354, 372, 488, 489

[56] References Cited

U.S. PATENT DOCUMENTS

| | | | |
|---|---|---|---|
| 4,526,431 | 7/1985 | Kasukawa | 439/352 X |
| 4,582,378 | 4/1986 | Fruchard | 439/352 X |
| 4,940,430 | 7/1990 | Fujitani et al. | 439/352 X |
| 4,993,967 | 2/1991 | Matsumoto | 439/352 X |
| 5,154,630 | 10/1992 | Kamono et al. | 439/352 |

FOREIGN PATENT DOCUMENTS 62-22381 1/1987 Japan .

*Primary Examiner*—Khiem Nguyen

*Attorney, Agent, or Firm*—Wigman, Cohen, Leitner & Myers

[57] ABSTRACT

A connector provided with an unlocking member comprises: a female connector housing formed with a locking pawl portion; a male connector housing formed with a flexible locking arm having a locking projection engaged with the locking pawl portion of the female connector housing; an unlocking member formed with an unlock drive projection and a male connector removal portion. When moved within the female connector housing, the unlocking member deforms the flexible locking arm by bringing the unlock drive projection thereof into contact with the locking projection to disengage the locking projection from the locking pawl portion and further removes the male connector housing from the female connector housing by the male connector removal portion thereof. In the connector, since the locking condition of both male and female connector housings can be released simply by pulling-out or pushing-in the unlocking member, it is possible to facilitate connector unlocking work within a narrow space.

6 Claims, 7 Drawing Sheets

CONNECTOR WITH UNLOCKING MEMBER

TECHNICAL FIELD

The present invention relates to a connector suitable for use to connect wire harness of an automotive vehicle, and more specifically to a connector provided with an unlocking member for unlocking a locked connector composed of male and female connector housings.

BACKGROUND ART

FIGS. 1 and 2 show an example of a conventional connector provided with a lock and unlock mechanism, which is disclosed in Japanese Patent Laid Open (Kokai) No. 62-22381.

In these drawings, the connector is composed of a male connector housing a and a female connector housing d. The male connector housing a is formed with a flexible locking arm b and an arch-shaped lock guard portion c. The flexible locking arm b is further formed with a locking projection $b_1$ and an arch-shaped unlocking portion $b_2$. On the other hand, the female connector housing d is formed with a lock pawl portion e.

Therefore, when the male connector housing a is inserted into the female connector housing d as shown in FIG. 2, since the locking projection b1 is engaged with the lock pawl portion e, the two male and female connector housings a and d are locked to each other. On the other hand, when the arch-shaped unlocking portion b2 is pushed down, since the locking projection b1 is disengaged from the lock pawl portion e, the two male and female connector housings a and d are unlocked from each other. Here, the arch-shaped lock guard portion c serves to prevent the locked conditions of both the locking projection b1 and the lock pawl portion e from being released inadvertently by an unexpected force.

In the conventional connector provided with the lock and unlock mechanism as described above, however, when the connector is required to be unlocked within a narrow or limited space within an automotive vehicle, since the arch-shaped lock guard portion c is present, there exists a problem in that it is not easy to unlock the connector by the worker's fingers. In other words, it has been difficult to push the unlocking portion b2 from above in the transversal direction of the connector housings within a narrow and small space, for removal of the male connector housing a form the female connector housing d.

SUMMARY OF THE INVENTION

With these problems in mind, therefore, it is the primary object of the present invention to provide a connector provided with an unlocking member, by which the male connector housing can be easily removed from the female connector housing even within a narrow space or a limited space, by simply pulling out or pushing in an unlocking member along the longitudinal direction of the connector housings.

To achieve the above-mentioned object, the present invention provide a connector provided with an unlocking member comprises: a female connector housing (A, A') formed with a locking pawl portion (5, 5'); a male connector housing (B, B') formed with a flexible locking arm (12, 12') having a locking projection (14, 14') engaged with the locking pawl portion of said female connector housing; and an unlocking member (C, C') formed with an unlock drive projection (10, 10') and a male connector removal portion (8, 8'), said unlocking member being so arranged that, when moved within said female connector housing, said unlocking member deforming the flexible locking arm (12, 12') of said male connector housing by bringing the unlock drive projection (10, 10') thereof into contact with the locking projection (14, 14') of said male connector housing to disengage the locking projection (14, 14') of said male connector housing from the locking pawl portion (5, 5') of said female connector housing and further removing said male connector housing from said female connector housing by the male connector removal portion (8, 8') thereof.

Further, the male connector housing (B) is further formed with at least one unlock driven projection (13), when moved within said female connector housing, said unlocking member deforming the flexible locking arm (12) of said male connector housing by bringing the unlock drive projection (10) thereof into contact with the unlock driven projection (13) of said male connector housing to disengage the locking projection (14) of said male connector housing from the locking pawl portion (5) of said female connector housing.

The locking member (C) is pulled out of said female connector housing to remove said male connector housing from said female connector housing, or else the locking member (C') is pushed into said female connector housing to remove said male connector housing from said female connector housing.

In the connector provided with an unlocking member according to the present invention, when the unlocking member is pulled out of or pushed into the female connector housing, since the flexible locking arm of the male connector housing is deformed by bringing the unlock drive projection of the unlocking member into contact with the locking projection or the unlock driven projection of the male connector housing, the locking projection of the male connector housing can be disengaged from the locking pawl portion of the female connector housing, and further the male connector housing can be removed from the female connector housing by the male connector removal portion of the unlocking member.

DETAILED DESCRIPTION OF THE PREFERRED EMBODIMENTS

Figure 1:
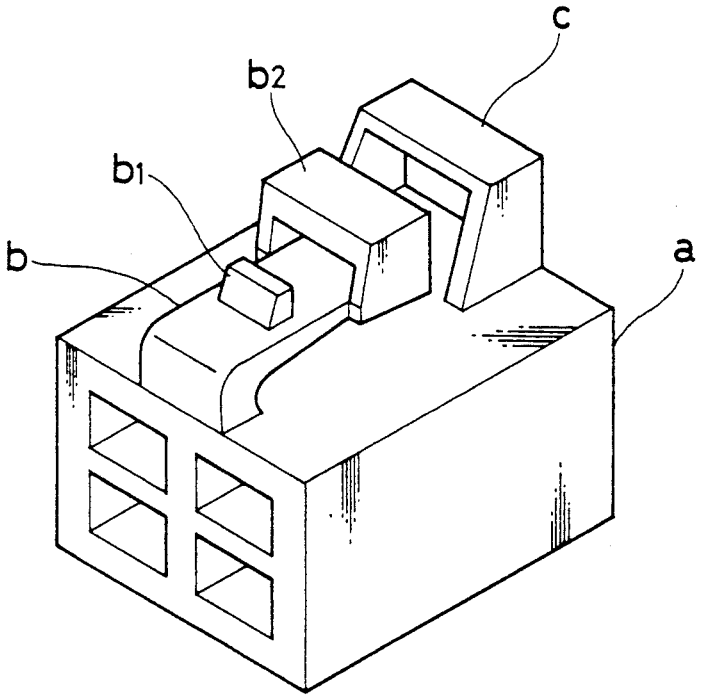
FIG. 1 PRIOR ART
FIG. 1 is a perspective view showing a male connector housing of an example of a conventional connector provided with a lock and unlock mechanism.
Figure 2:
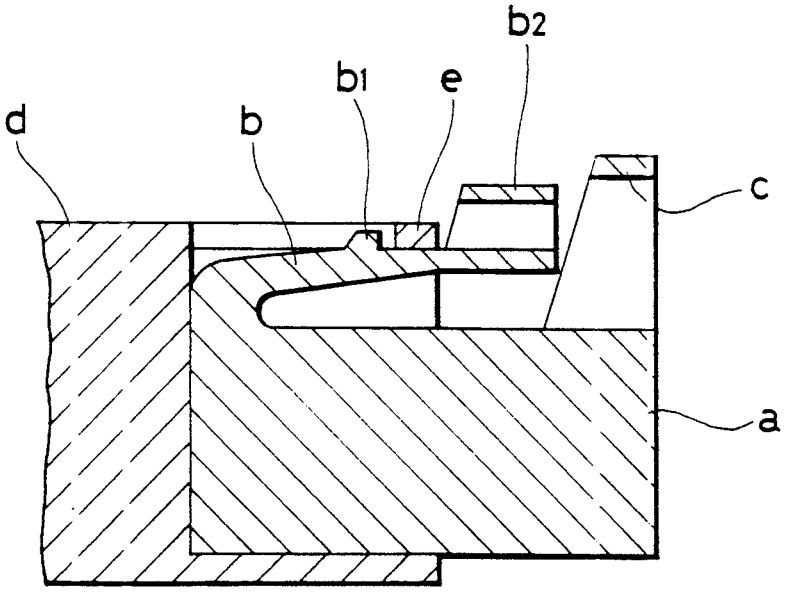
FIG. 2 PRIOR ART
FIG. 2 is a cross-section view showing the same conventional connector shown in FIG. 1, in which the male and female connector housings are engaged with each other under locked condition.
Figure 3:
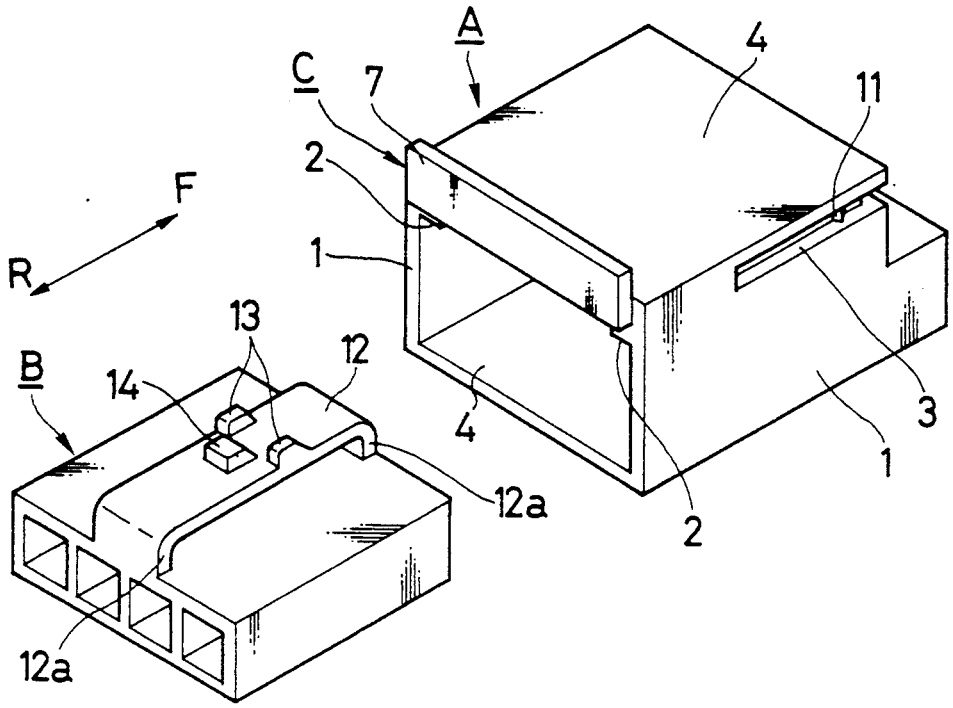
FIG. 3 is a perspective view showing a first embodiment of the connector provided with an unlocking member, in which a male connector housing is disengaged from a female connector housing.

A first embodiment of the connector provided with an unlocking member according to the present invention will be described hereinbelow with reference to FIGS. 3 to 10. The connector is composed of a female connector housing A, a male connector housing B and an unlocking member C, as shown in FIG. 3. Further, the unlocking member C is removably engaged with the female connector housing A, as shown in FIG. 4.

Figure 4:
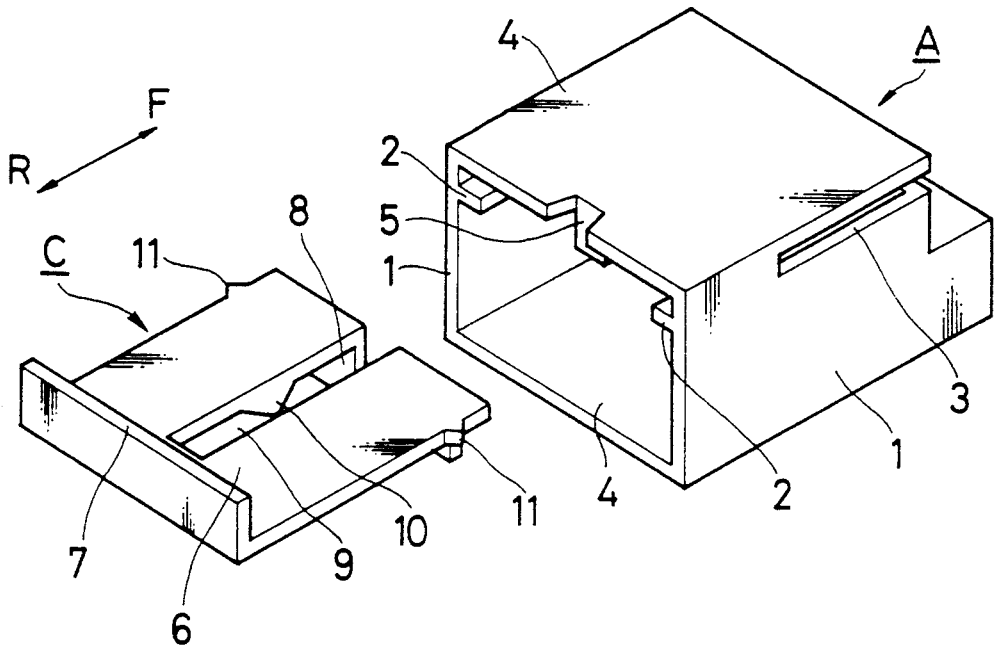
FIG. 4 is a perspective view showing the first embodiment of the connector provided with an unlocking member, in which an unlocking member is removed from the female connector housing.

In FIG. 4, the female connector housing A is formed with two side walls 1 and upper and lower walls 4. Under the upper wall 4, two opposing unlocking member guide portions 2 are formed extending in the front and rear (R−F) or the longitudinal direction of the connector. Further, under the upper wall 4, two opposing side slits 3 are formed in the two side walls 1 also extending in the front and rear direction. Further, a locking pawl portion 5 extending downward is formed on the rear side and at the middle portion of the upper wall 4.

Figure 5:
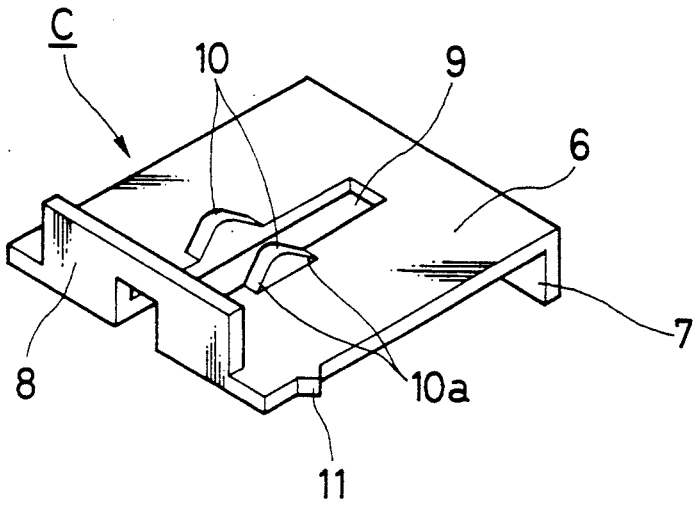
FIG. 5 is a perspective view showing a reverse side of the unlocking member.

In FIGS. 4 and 5, the unlocking member C is formed with an unlocking member pull-out portion 7 bent vertically upward at the rearmost end of a plate portion 6 and a male connector removal portion 8 bent vertically downward at the front end of the pate portion 6. Further, the unlocking member C is formed with a longitudinal slit 9 loosely engaged with the downward extending locking pawl portion 5 of the female connector housing A, a pair of angular unlock drive projections 10 (see FIG. 5) each having two opposing sloped surfaces 10*a* extending in the front and rear direction and located on the inner surface of the plate portion 6 and on both sides of the slit 9, and a pair of horizontal triangular projections 11 extending in the transversal direction of the connector housing.

Therefore, the unlocking member C can be engaged with the female connector housing A as follows: First, the front end of the plate portion 6 is fitted to the unlocking member guide portions 2; the unlocking member C is further pushed into the female connector housing A until the horizontal triangular projections 11 are engaged with the two side slits 3. Under these engage conditions, the downward extending locking pawl portion 5 is located in the longitudinal slit 9 formed in the plate portion 6 of the unlocking member C, and further the unlocking member C is movably engaged with the female connector housing A with the two horizontal traingular projections 11 engaged with the two side slits 3 of the female connector housing A.

As shown in FIG. 3, the male connector housing B is formed with a flexible locking arm 12 of fixed beam type on the upper surface thereof so as to extend in the front and rear direction. The flexible locking arm 12 is formed with a pair of angular unlock driven projections 13 each having a sloped guide surface 13*a* (see FIG. 7) on the front side and a locking projection 14 having a sloped surface 14*a* (see FIG. 7) also on the front side, respectively.

The locking and unlocking operation of the connector provided with the unlocking member C according to the present invention will be described hereinbelow with reference to FIGS. 6 to 11.

Figure 6:
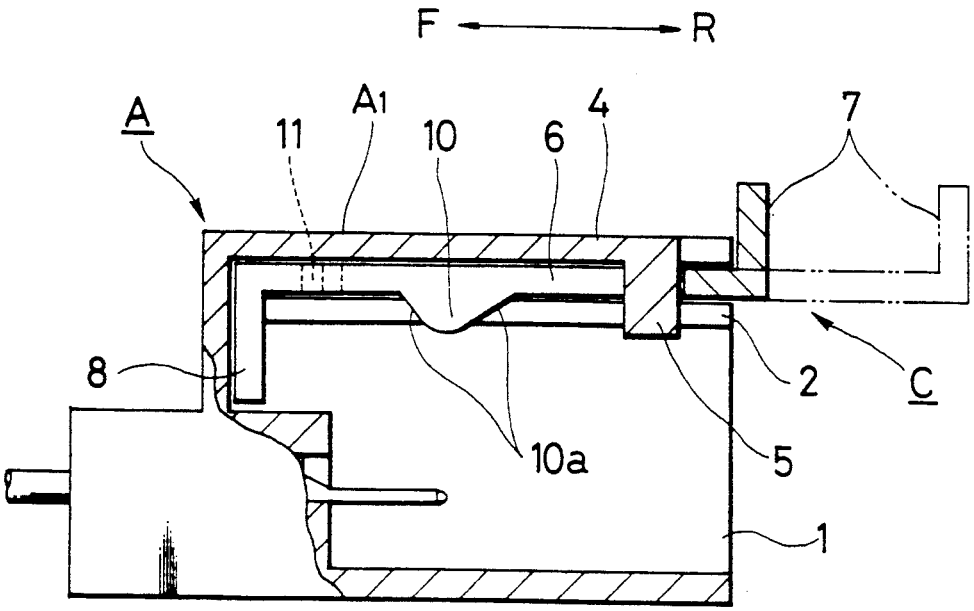
FIG. 6 is a cross-sectional view showing the female connector housing to which the unlocking member is inserted.

FIG. 6 shows the state where the unlocking member C is inserted into and further engaged with the female connector housing A. In these conditions, the unlocking member C is movable in the female connector housing between the solid line position and the dot-dot-dashed line position, because the two horizontal triangular projections 11 of the unlocking member C are slidable along the two side slits 3 of the female connector housing A.

Figure 7:
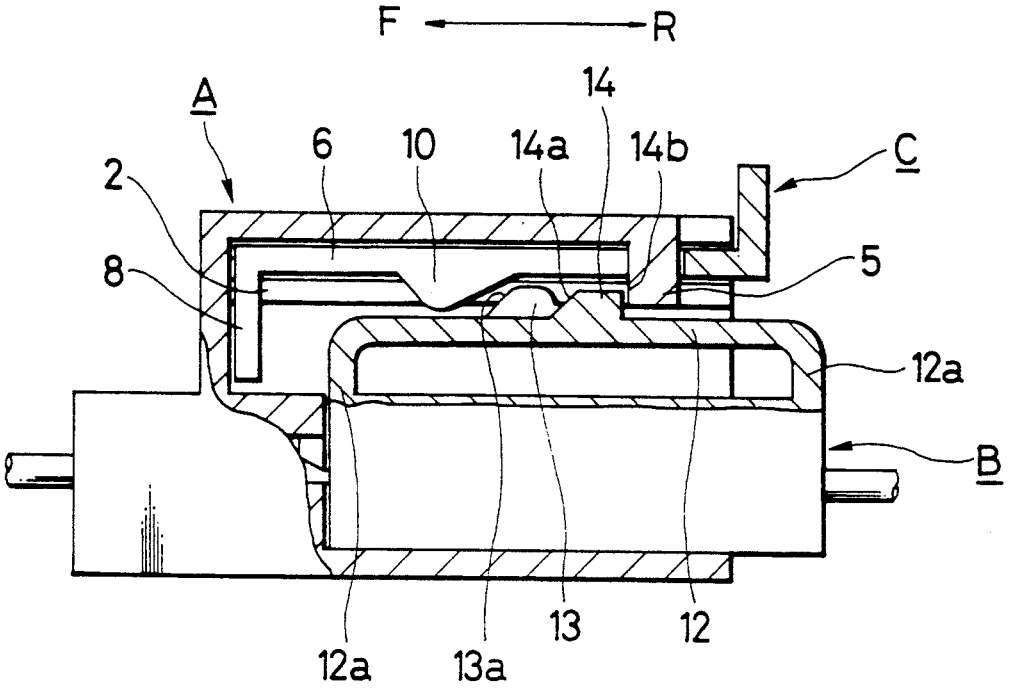
FIG. 7 is a cross-sectional view showing the connector shown in FIG. 3, in which the male connector housing is engaged with the female connector housing under locked condition.

Under these conditions, when the male connector housing B is inserted into the female connector housing A, since the sloped surface 14*a* of the locking projection 14 is brought into contact with the lock pawl portion 5, the flexible locking arm 12 is deformed in the inward direction of the male connector housing B, so that the locking projection 14 can be moved over the lock pawl portion 5. After that, the flexible locking arm 12 is restored into the locked condition in which a vertical locking surface 14*b* (see FIG. 7) is engaged with the locking pawl portion 5, as shown in FIG. 7. Under these engaged conditions, a pair of connector terminals (not shown) provided in the male and female connector housings A and B can be connected to each other.

Figure 8:
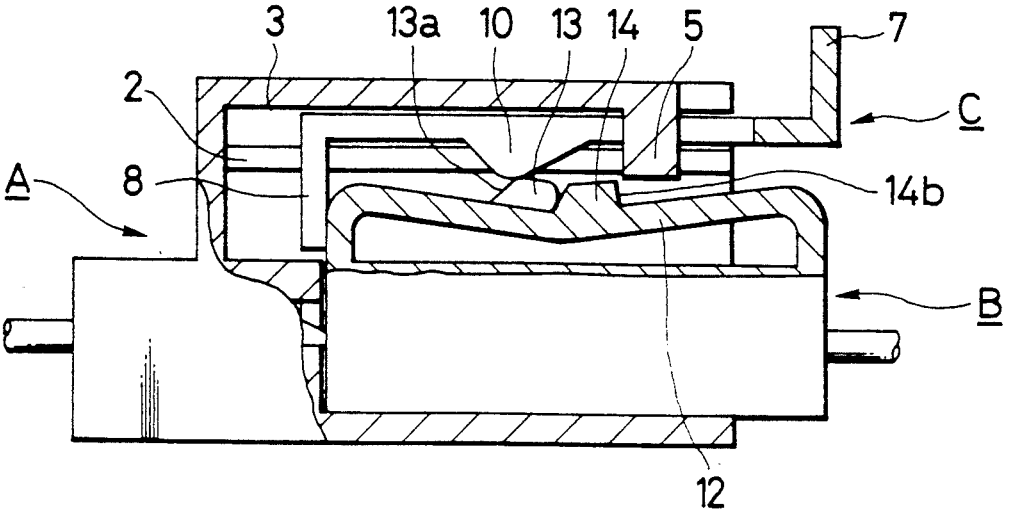
FIG. 8 is a cross-sectional view showing the connector shown in FIG. 3, in which the unlocking member is slightly pulled out of the female connector housing to unlock the male connector housing from the female connector housing.
Figure 9:
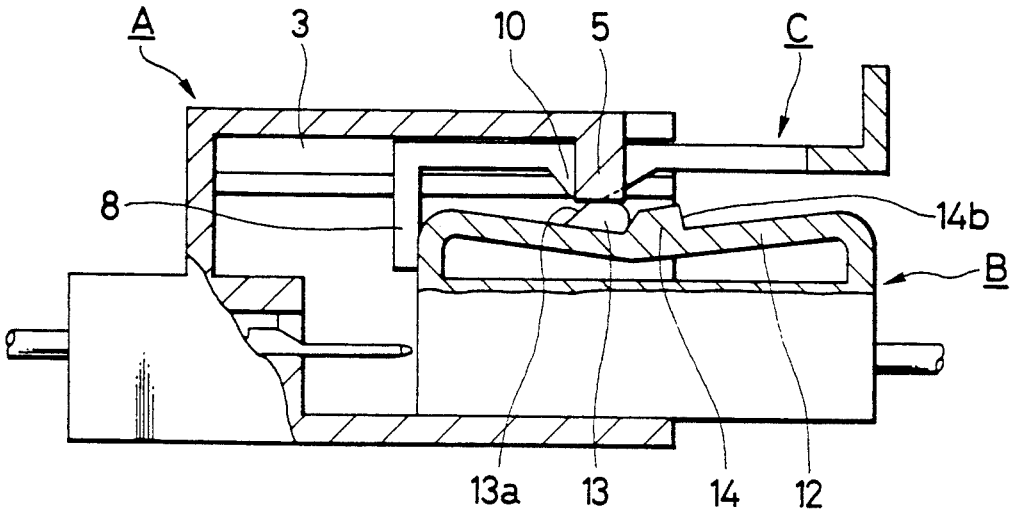
FIG. 9 is a cross-sectional view showing the connector shown in FIG. 3, in which the unlocking member is sufficiently pulled out of the female connector housing and thereby the male connector housing is unlocked from the female connector housing.
Figure 10:
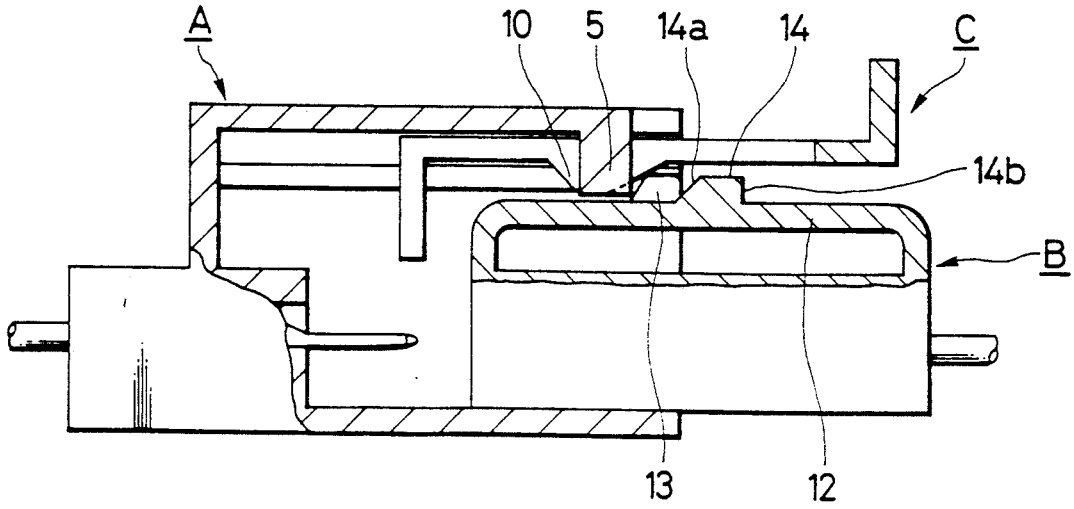
FIG. 10 is a cross-sectional view showing the connector shown in FIG. 3, in which the unlocking member is sufficiently pulled out of the female connector housing and thereby the male connector housing can be removed from the female connector housing.

As shown in FIG. 8, when the unlocking member C is extracted for unlocking operation by moving the unlocking member pull-out portion 7 of the unlocking member C in the rear direction of the connector, since the unlock drive projections 10 of the unlocking member C pushes the unlock driven projections 13 inward, the flexible locking arm 12 is deformed, so that the locking projection 14 is disengaged from the locking pawl portion 5. Under these conditions, since the male connector removal portion 8 of the unlocking member C is in contact with a front end surface 12*a* (see FIG. 7) of the male connector housing B, when the unlocking member pull-out portion 7 is further pulled out, since the locking projection 14 of the male connector housing B is perfectly disengaged from the locking pawl portion 5 of the female connector housing A as shown in FIG. 9, the male connector housing B can be removed from the female connector housing A, as shown in FIG. 10.

Figure 11:
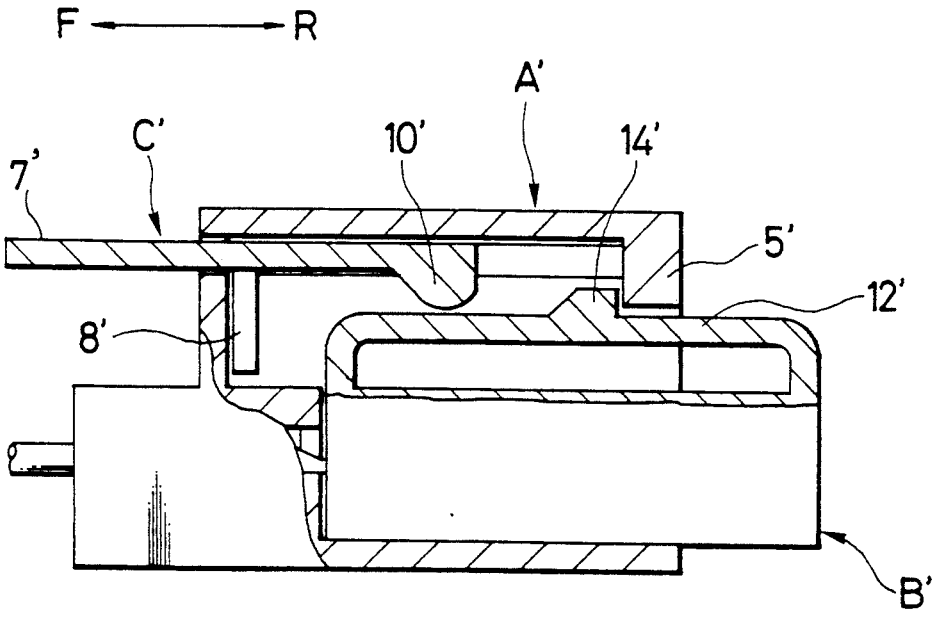
FIG. 11 is a cross-sectional view showing a second embodiment of the connector provided with an unlocking member, in which a male connector housing is engaged with a female connector housing under locked condition.

FIG. 11 shows a second embodiment of the connector provided with an unlocking member according to the present invention. In the first embodiment, the male and female connector housings A and B can be removed by pulling the unlocking member C from the female connector housing (A) side to the male connector housing (B) side. In contrast with this, in this second embodiment, the male connector housing can be removed from the female connector housing by pushing the unlocking member from the female connector housing side to the male connector housing side. Further, in this second embodiment, the two unlock driven projections 13 of the male connector housing B is omitted.

In more detail, an unlocking member C' is engaged with a female connector housing A', and a male connector housing B' is engaged with the female connector housing A'. An unlocking member push-in portion 7' projects from the front side of the female connector housing A'. In the same way, as with the case of the first embodiment, the unlocking member C' is formed with an unlock drive projection 10'. The male connector housing B' is formed with a flexible locking arm 12' of fixed beam type. Further, the flexible locking arm 12' is formed with a locking projection 14'. However, no unlock driven projections are formed in the male connector housing B'.

In FIG. 11, when the unlocking member C' is pushed toward the male connector housing B', since the unlock drive projections 10' of the unlocking member C' push the locking projections 14' of the male connector housing B', the flexible locking arm 12' of the male connector housing B' is deformed inward, so that the male connector housing B' can be moved by the male connector removal portion 8' of the unlocking member C'. When the locking projections 14' are moved into contact with the lower surface of the locking pawl portion 5', since the two connector housings A' and B' can be unlocked, the male connector housing B' can be further removed from the female connector housing A' freely.

As described above, in the connector provided with an unlocking member according to the present invention, since the male connector housing can be removed from the female connector housing, by simply pulling out or pushing in the unlocking member in the longitudinal direction of the connector, without providing any guard portion, it is possible to easily release the locking condition of the male and female connector housings, while improving the connection reliability of the two connector housings.

What is claimed is:

1. A connector provided with an unlocking member, comprising:

a female connector housing having an opening provided at an end thereof, being formed with a locking pawl portion projecting from a wall of said female connector housing and extending in an inward direction;

a male connector housing for being fitted into the opening of said female connector housing, being formed with a flexible locking arm extending in a fitting direction and being supported by a wall of said male connector housing at both ends thereof and having a locking projection engagable with the locking pawl portion of said female connector housing; and an unlocking member held by said female connector housing so as to be slidable in a direction opposite to the fitting direction during disengagement of the male connector housing from the female housing, being formed with an unlock drive projection and a male connector removal portion, said unlocking member being so arranged that, when moved within said female connector housing, said unlocking member deforms the flexible locking arm of said male connector housing by bringing the unlock drive projection thereof into contact with the locking projection of said male connector housing to disengage the locking projection of said male connector housing from the locking pawl portion of said female connector housing and further removing said male connector housing from said female connector housing by urging said male connector housing past the male connector removal portion thereof.

2. The connector provided with an unlocking member of claim 1, wherein said unlocking member is pulled out of said female connector housing to remove said male connector housing from said female connector housing.

3. The connector provided with an unlocking member of claim 1, wherein said unlocking member is pushed into said female connector housing to remove said male connector housing from said female connector housing.

4. A connector provided with an unlocking member comprising:

a female connector housing having an opening at an end thereof, being formed with a locking pawl portion projecting from a wall of said female connector toward an inside thereof;

a male connector housing for being fitted into the opening of said female connector, being integrally formed with a flexible locking arm extending in a fitting direction and supported by a wall of said male connector housing at both ends thereof, said flexible locking arm having a locking projection engaged with the locking pawl portion of said female connector housing and at least one unlock driven projection projecting from said flexible locking arm; and an unlocking member held by said female connector so as to be slidable in a direction opposite to the fitting direction during disengagement of the male connector housing from the female connector housing, being formed with at least one unlock drive projection and a male connector removal portion, said unlocking member being so arranged that, when moved within said female connector housing, said unlocking member deforms the flexible locking arm of said male connector housing by bringing the unlock drive projection thereof into contact with the unlock driven projection of said male connector housing to disengage the locking projection of said male connector housing from the locking pawl portion of said female connector housing and further removing said male connector housing from said female connector housing by pushing said male connector by the male connector removal portion thereof.

5. The connector as claimed in claim 4, wherein said unlocking member is pulled out of said female connector housing to remove said male connector housing from said female connector housing.

6. The connector as claimed in claim 4, wherein said unlocking member is pushed into said female connector housing to remove said male connector housing from said female connector housing.

* * * * *